US005595072A

United States Patent [19]

Bai et al.

[11] Patent Number: 5,595,072

[45] Date of Patent: Jan. 21, 1997

[54] WATER CURRENT FORMING APPARATUS OF WASHING MACHINE

[75] Inventors: Sang-Chul Bai, Suwon; Joon-Sang Park, Seoul, both of Rep. of Korea

[73] Assignee: Samsung Electronics Co., Ltd., Suwon, Rep. of Korea

[21] Appl. No.: 400,956

[22] Filed: Mar. 8, 1995

[30] Foreign Application Priority Data

Mar. 8, 1994 [KR] Rep. of Korea ..... 94-4476

[51] Int. Cl.[6] ..... D06F 39/08

[52] U.S. Cl. ..... 68/133; 68/183; 68/207

[58] Field of Search ..... 68/23.5, 207, 133, 68/183, 23.6

[56] References Cited

U.S. PATENT DOCUMENTS

| | | | |
|---|---|---|---|
| 2,358,691 | 9/1944 | Dehle . | |
| 2,882,706 | 4/1959 | Brucken | 68/23.5 |
| 2,969,665 | 1/1961 | Saverio . | |
| 3,103,113 | 9/1963 | Platt et al. | 68/23.5 |
| 3,195,327 | 7/1965 | Cobb | 68/23.5 |
| 3,203,013 | 8/1965 | Buss | 68/23.5 |
| 3,256,720 | 6/1966 | Green et al. | 68/23.5 |
| 3,330,135 | 7/1967 | Douglas | 68/207 |
| 5,161,394 | 11/1992 | Felzer et al. | 68/207 |
| 5,220,813 | 6/1993 | Chen et al. | 68/183 |

FOREIGN PATENT DOCUMENTS 57-183893 11/1982 Japan .

*Primary Examiner*—Frankie L. Stinson
*Attorney, Agent, or Firm*—Burns, Doane, Swecker & Mathis, L.L.P.

[57] ABSTRACT

A clothes washing machine includes outer and inner tubs, the inner tub being rotatable to perform a spin-dry operation. An oscillating pulsator is disposed in the inner tub for agitating water and laundry in the inner tub. A pumping member disposed below the pulsator is oscillatable along with the pulsator for pumping water upwardly through a central opening in the pulsator to generate an upward water current in a center of the inner tube which minimizes entanglement of clothes during a wash cycle.

8 Claims, 6 Drawing Sheets

WATER CURRENT FORMING APPARATUS OF WASHING MACHINE

BACK GROUND OF THE INVENTION

1. Field of the Invention

The present invention relates to a water current forming apparatus of a washing machine.

2. Description of the Prior Art

One example of a washing machine adapted to wash laundry in a washing-cum-spindrying tub by forming a water current is disclosed in Japanese Patent Laid-open Publication Sho 57-183893 Published on Nov. 12, 1982.

The washing machine disclosed in the Japanese Publication No. 57-183893 is so constituted that rotary blades are rotatably mounted with a rotary disc at an absorption side thereof for being concentrically disposed with the rotary blades and for rotating free from a rotative speed of the rotary blades, where the laundry is washed by water current formed by the washing water being sucked in and spurted through the rotary disc to the rotary blades.

Meanwhile, an example of such a conventional washing machine is illustrated in FIG. 1.

As illustrated in FIG. 1, the conventional washing machine includes an outer tub 3 fixedly disposed in a body i of the washing machine, and a power transmission apparatus 13 being arranged under the outer tub 3 to receive a turning effect of a motor 5 through a belt 7 and to thereafter transmit a drive power to a washing-cum-spindrying tub 9 or a pulsator 11.

In other words, the outer tub 3 is provided at an interior thereof with the washing-cum-spindrying tub 9 for spindrying the laundry by way of centrifugal force generated by a driving of the motor 5. The tub 9 is mounted on a spindrying shaft 21 of the power transmission. Rotatably disposed within the spindrying shaft is a washing shaft 23 of the power transmission apparatus 13. The washing shaft is connected to the pulsator 11 to oscillate the pulsator for forming the water current in the washing water stored in the washing-cum-spindrying tub 9 to thereby carry out the washing.

Furthermore, the body 1 of the washing machine is arranged at an upper side thereof with water supply means 17 for supplying the washing water into the washing-cum-spindrying tub 9 by being connected to a faucet 15 through the intermediary of a hose 16. The outer tub 3 is provided at a bottom area thereof with drainage means 19 for draining out the washing water.

In the conventional washing machine thus constructed, when the laundry tossed into the washing-cum-spindrying tub 9 in the outer tub 3, and a washing condition is selected on a control panel (not shown), hot water or cold water is supplied into the washing-cum-spindrying tub 9 through the water supply means 17.

When a predetermined quantity of water is supplied into the washing-cum-spindrying tub 9 above a certain level, turning a effect resulting from an operation of the motor 5 is transmitted to the power transmission apparatus 13 through a belt 7, the turning effect is reduced and transmitted to the pulsator 11 to thereby rotate the same.

At this time, the pulsator 11 oscillates about a vertical axis to thereby form the water current in the washing-cum-spindrying tub 9, so that the washing can be carried out.

When the washing is completed, the washing water is drained out according to the operation of the drainage means 19.

When the water is supplied again through the water supply means 17, rinsing operations are performed several times, and the washing-cum-spindrying tub 9 which has received a driving force of the power transmission apparatus 13 through a spindrying shaft 21 is rotated at a high speed.

At this time, the spindrying is performed on the laundry by way of the centrifugal force, so that the washing can be completed.

However, in the conventional washing machine thus constructed, when the pulsator 11 disposed on a washing shaft 23 of the power transmission apparatus 13 repeats the forward or reverse rotations during the washing and rinsing operations, the washing water stored in the outer tub 3 is taken in through a suction inlet 301 formed at a bottom surface of the washing-cum-spindrying tub 9, and thereafter, a centrifugal water current is formed, as shown by arrows, in the washing-cum-spindrying tub 9 by the agitators 113 and pumping blades 111 of the pulsator 11. The blades 111 are arranged for discharging the water upwards in the washing-cum-spindrying tub 9. However, the centrifugal water current causes the laundry to be entwined near a central axis line 901 of the washing-cum-spindrying tub 9.

The entwinement of the laundry therefore causes reduction of washing and rinsing efficiencies in the washing machine.

SUMMARY OF THE INVENTION

Accordingly, the present invention is disclosed to solve the above-mentioned disadvantages, and it is an object of the present invention to provide a water current forming apparatus adapted to eject the washing water upwards from a central area of the pulsator to thereby form a centrally erupted water current, so that entwinement of the laundry is prevented, thereby improving the washing and rinsing efficiencies.

In accordance with the object of the present invention, there is provided a water current forming apparatus of a washing machine employing an outer tub for storing the washing water, a washing-cum-spindrying tub for being disposed within the outer tub to thereby spindry the laundry by way of centrifugal force, a spindrying shaft for being arranged under a central bottom area of the washing-cum-spindrying tub in order to rotate the washing-cum-spindrying tub according to driving of a power transmission apparatus, and a washing shaft rotatably disposed within the spindrying shaft, the apparatus comprising:

a connected fixedly arranged at a periphery of the washing shaft;

a pumping member disposed at a periphery of the connector in order to pump the washing water stored in the outer tub and to eject the same toward an upper central area in the washing-cum-spindrying tub;

a pulsator for being provided at the connector in order to agitate the laundry and the washing water in the washing-cum-spindrying tub; and a housing member for being disposed in the washing-cum-spindrying tub in order to guide the water current formed in accordance with the operation of pumping member.

BRIEF DESCRIPTION OF THE DRAWINGS

Other objects and aspects of the invention will become apparent from the following description of embodiments with reference to the accompanying drawings in which.

DETAILED DESCRIPTION OF PREFERRED EMBODIMENTS OF THE INVENTION

Figure 1:
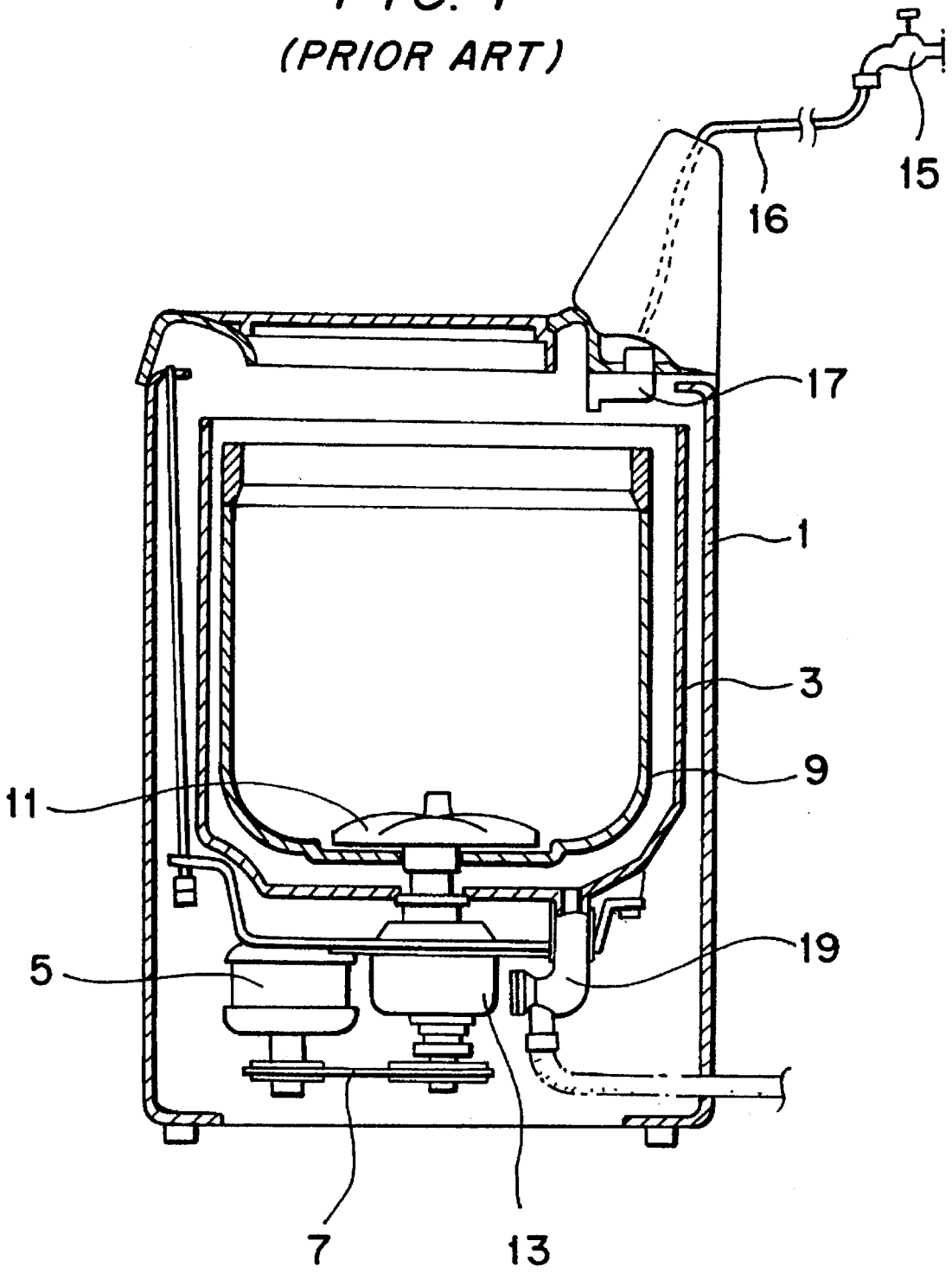
FIG. 1 (PRIOR ART)
FIG. 1 is a longitudinal sectional view for illustrating a conventional washing machine.
Figure 2:
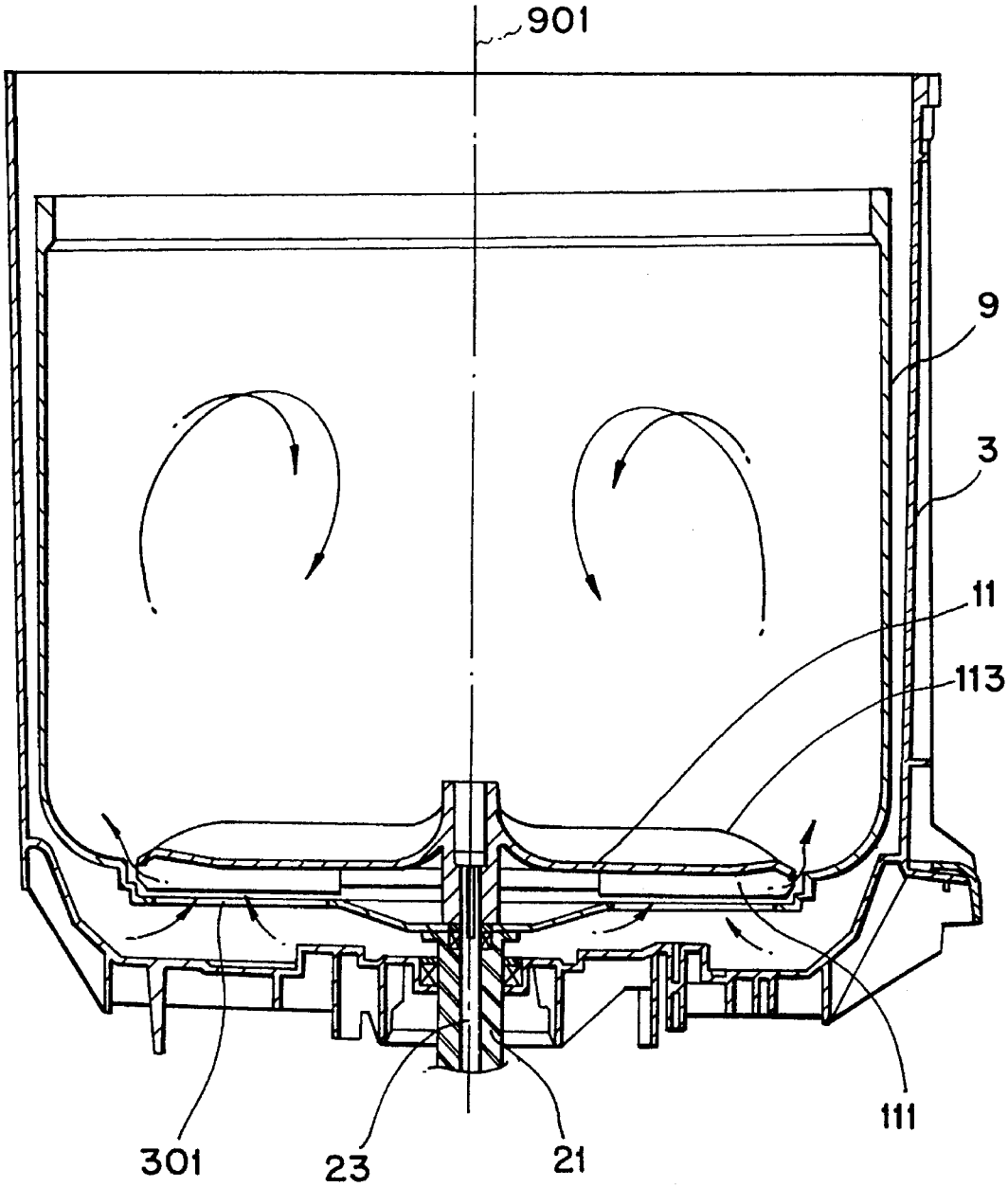
FIG. 2 (PRIOR ART)
FIG. 2 is a longitudinal sectional view of a water current forming mechanism in the conventional washing machine.

One embodiment of the present invention will now be described in detail with reference to the accompanying drawings. Throughout the drawings, like portions and reference numerals are used for designation of like or equivalent parts or portions as in FIGS. 1 and 2 and redundant references will be omitted for simplicity of illustration and explanation.

Figure 3:
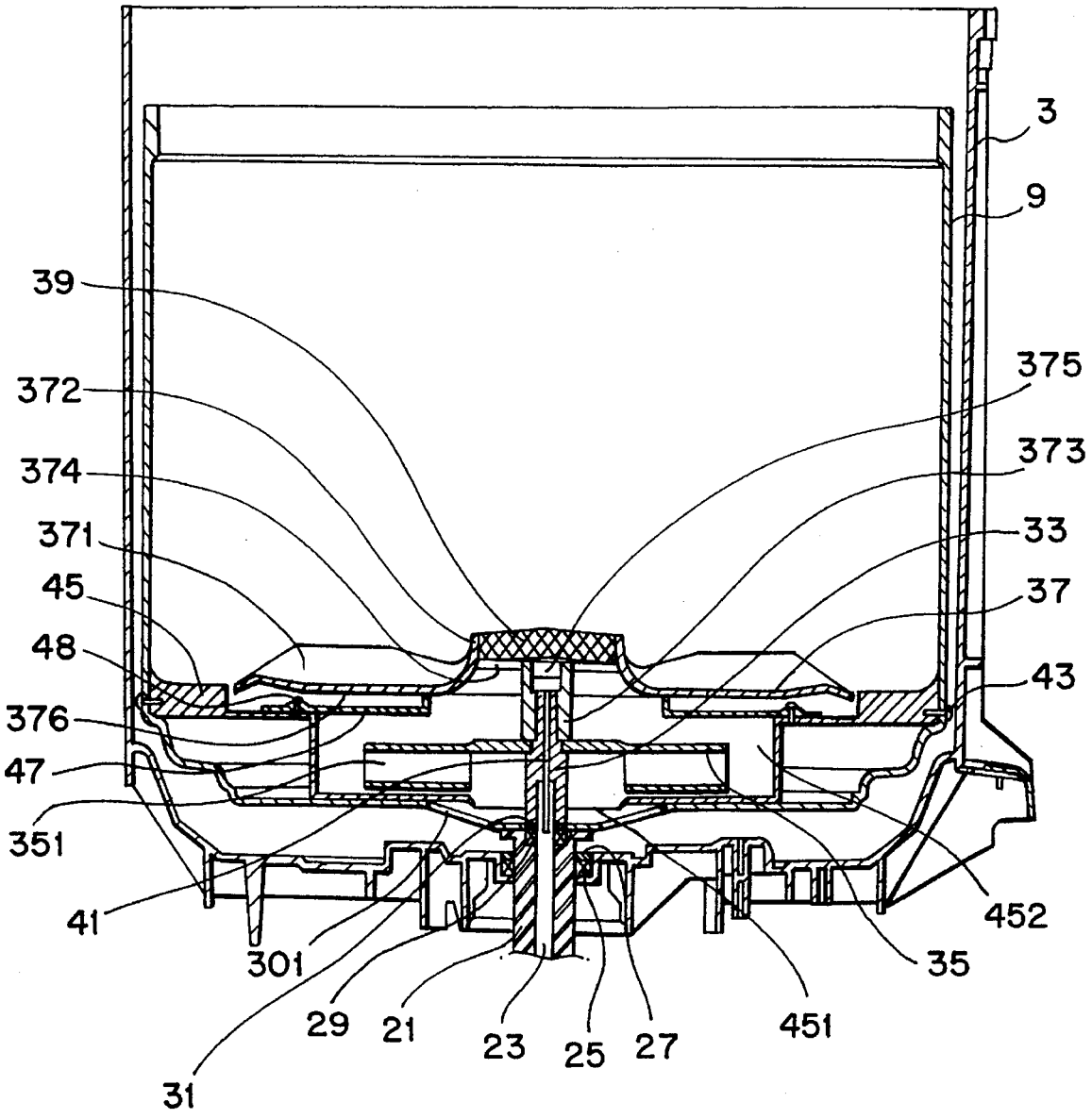
FIG. 3 is a longitudinal sectional view for illustrating a water current forming apparatus of a washing machine according to one embodiment of the present invention.
Figure 4:
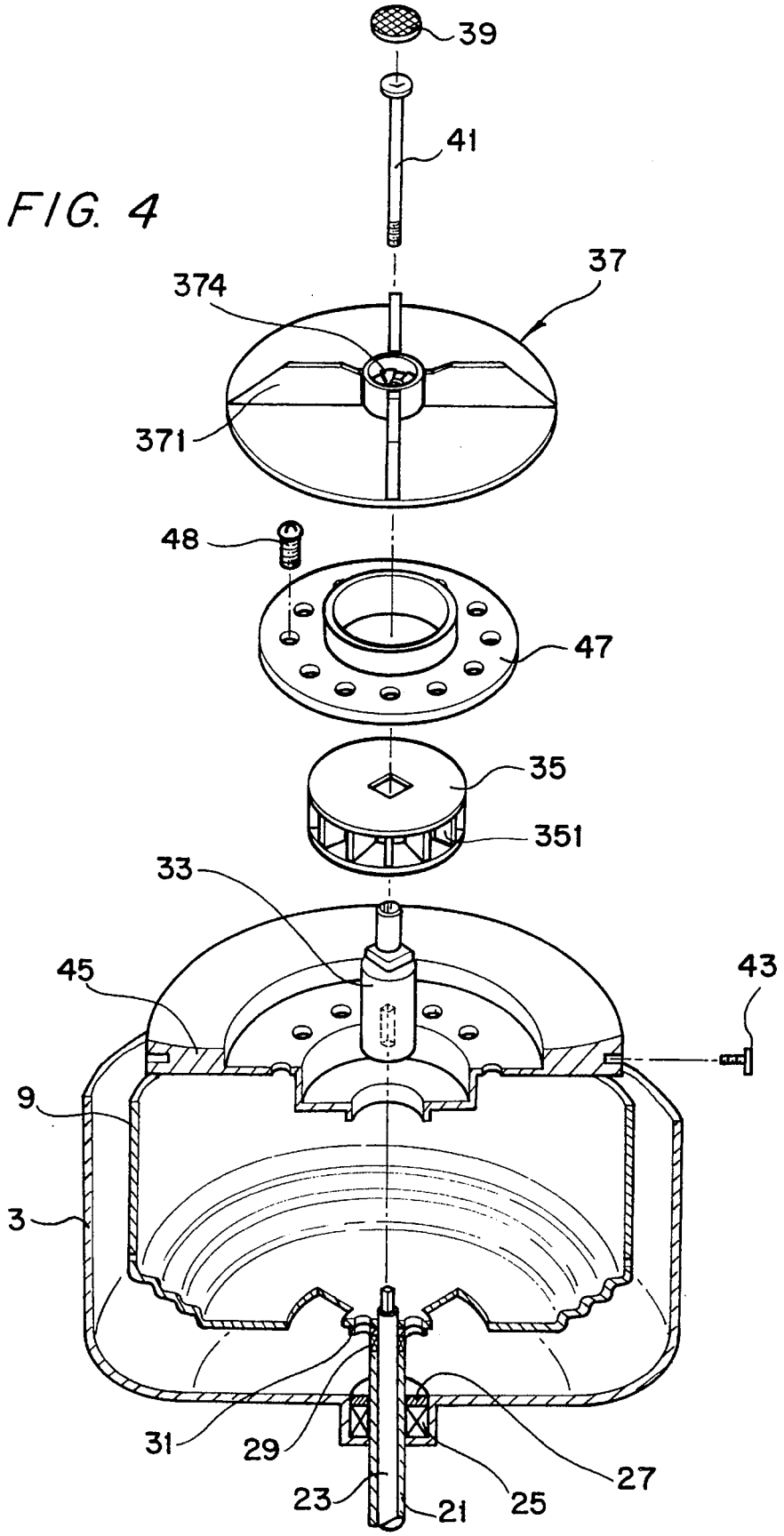
FIG. 4 is an exploded perspective view of the water current forming apparatus in FIG. 3.

As in FIGS. 3 and 4, a spindrying shaft 21 is rotatably disposed at an upper periphery thereof within a bearing member 25 in order to freely rotate. The bearing member 25 is provided at a periphery thereof with a seal member 27 lest the washing water in the outer tub 3 should leak through the bearing member 25 to an exterior of the outer tub 3.

Furthermore, a washing shaft 23 is disposed inside the spindrying shaft 21, and at the same time, is provided with a bearing member 29 in order to be rotatably relative to the washing shaft 23.

The bearing member 29 is provided at an upper side thereof with a seal member 31 lest the washing water in the washing-cum-spindrying tub 9 should leak through a chasm between the spindrying shaft 21 and the washing shaft 23 to the power transmission apparatus 13.

The washing shaft 23 is protrudes from the seal member 31 in order to be connected to a connector 33 of a multi-stage shaft member, and the protruded portion is connected by serrations at a periphery thereof to a lower portion of the connector 33.

Furthermore, the connector 33 is connected to a pumping member 35 having a plurality of blades 351 in order to discharge the washing water stored in the outer tub 3 upwards into the washing-cum-spindrying tub 9 by drawing that water through a suction inlet 301 formed at a bottom surface of the washing-cum-spindrying tub 9 and discharging it through a nozzle 374 arranged coaxially with the washing shaft 23 as will be discussed.

The connector 33 is coupled at its upper end to the pulsator 37 by means of serrations.

In the aforesaid description, the blades 351 extend radially in order to pump the washing water stored in the outer tub 3 while rotating in the same direction as that of the washing shaft 23.

The pulsator 37 includes an agitating blade unit 371 for agitating the washing water and the laundry, an ejection unit 372 for ejecting the washing water discharged from the pumping member 35 toward a central portion in the washing-cum-spindrying tub 9, and a boss unit 373 connected by serrations to an upper periphery of the connector 33.

The ejection unit 372 is formed with a recess in which filtering member 39 is so mounted that foreign objects cannot be flowed toward the pumping member 35.

Disposed at a bottom of the recess is an exhaust nozzle 374.

Furthermore, the boss unit 373 is formed therein with a center hole 375, through which a fastening member 41 is screwed to an interior of the washing shaft 23 so that the washing shaft 23, connector 33, pumping member 35 and pulsator 37 can rotate along with the washing shaft 23.

Meanwhile, a flange 211 formed at an upper end of the spindrying shaft 21 is fixedly connected at an upper surface thereof with the washing-cum-spindrying tub 9 by a fastening member (not shown). The washing-cum-spindrying tub 9 is provided at a lower portion thereof with a housing member 45 fixed by a plurality of fastening means 43, to an inner periphery of the washing-cum-spindrying tub 9 so that the washing water can be guided and the pumping member 35 can be received.

The housing member 45 is formed at a bottom surface thereof with an opening 451 so that the washing water absorbed through the suction inlet 301 in response to rotation of the pumping member 35 can be flowed into the pumping member 35.

The pumping member 35.

The open space 452 disposed in a space 452 located above the opening 451 and covered by cover member 47 fastened by fastening means 48 to the housing member 45 in order to guide the washing water discharged from the pumping member 35, to the nozzle 374 so that the pumped water is directed through a floor surface 376 of the pulsator 37.

Operation of the water current forming apparatus of the washing water and an effect thereof according to the embodiment of the present invention thus constructed will now be described.

Figure 5:
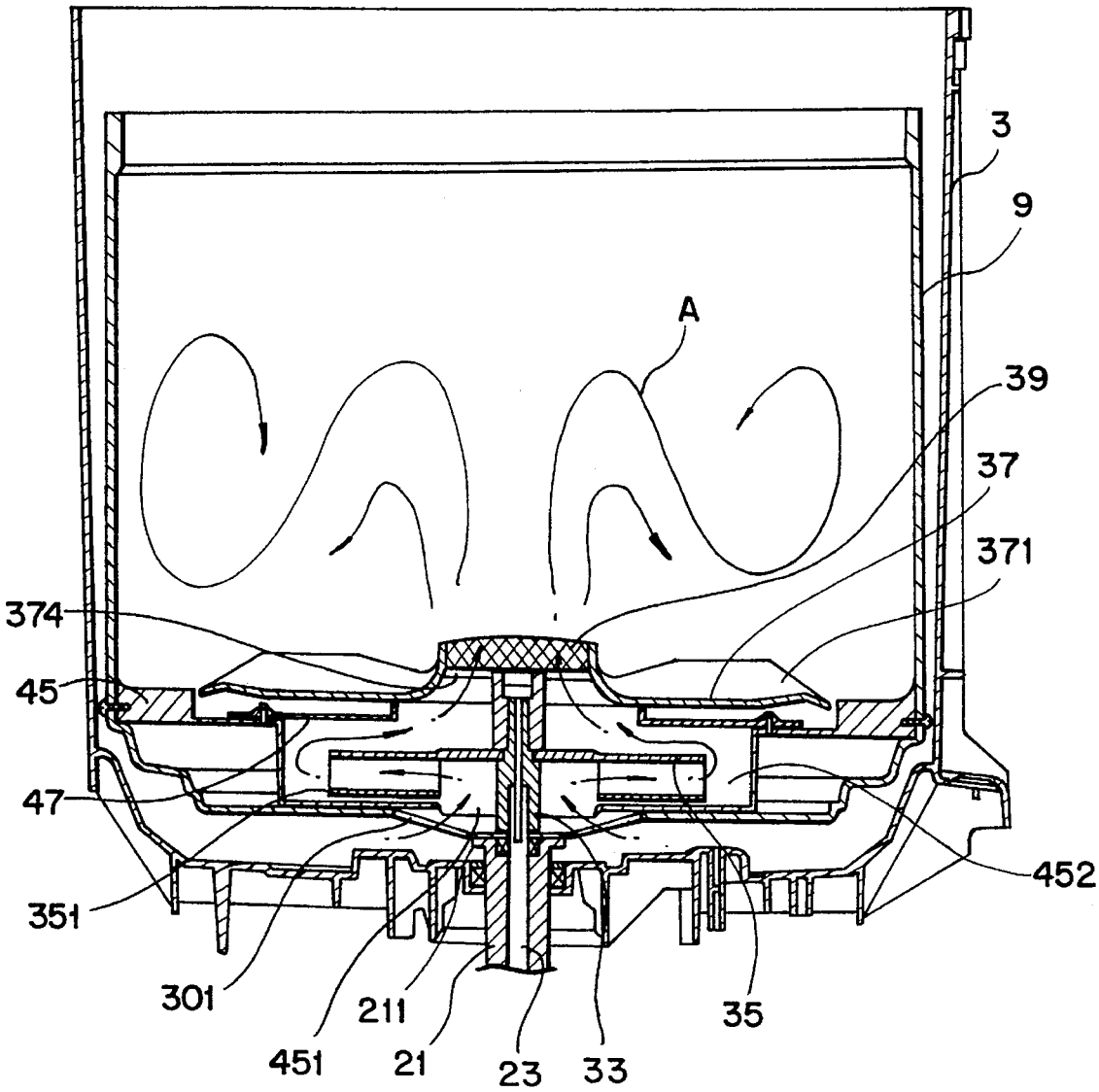
FIG. 5 is a longitudinal sectional view for illustrating a water current formed by the water current forming apparatus in the washing machine according to the embodiment of the present invention.

As illustrated in FIG. 5, in a state when the laundry, detergent and washing water are disposed in the washing-cum-spindrying tub 9, and when the washing shaft 23 is oscillated during the washing or rinsing processes, and the pumping member 35 and the pulsator 37 fixed to the washing shaft 23 by connector 33 are oscillated.

At this time, the washing water stored in the outer tub 3 passes the suction inlet 301 and the opening 451 in due order in response to rotation of the pumping member 35 and is sucked into the pumping member 35.

That sucked in washing water is discharged radially outwardly through the blades 351 of the pumping member 35, and guided through of the open space 452 by walls of the housing member 45 and the cover member 47 to thereafter be ejected upwards from a central portion of the washing-cum-spindrying tub 9 through the exhaust nozzle 374 The washing water is then formed into a centrally erupted water current as illustrated by an arrow (A).

At this time, it should be apparent that centrifugal water current as in the conventional washing machine is also formed by the agitating blade member 371 of the pulsator 37, Accordingly, there is formed a combined water current by the centrally erupted water current and the centrifugal water current according to the rotation of the pulsator 37.

Because the combined water current thus formed is caused to move toward the wall of the washing-cum-spindrying tub 9 the laundry is not entwined, and at the same time, because respective momenta on the parts of the laundry and the washing water are increased, washing and rinsing efficiencies are thereby increased.

Although the aforesaid description has explained an embodiment of a water current forming apparatus where the housing member 45 is attached to the inner periphery of the washing-cum-spindrying tub 9, and the pumping member 35 having blades of radial type and the like is arranged at the connector 33, the present invention is not limited to the scope of this embodiment.

Figure 6:
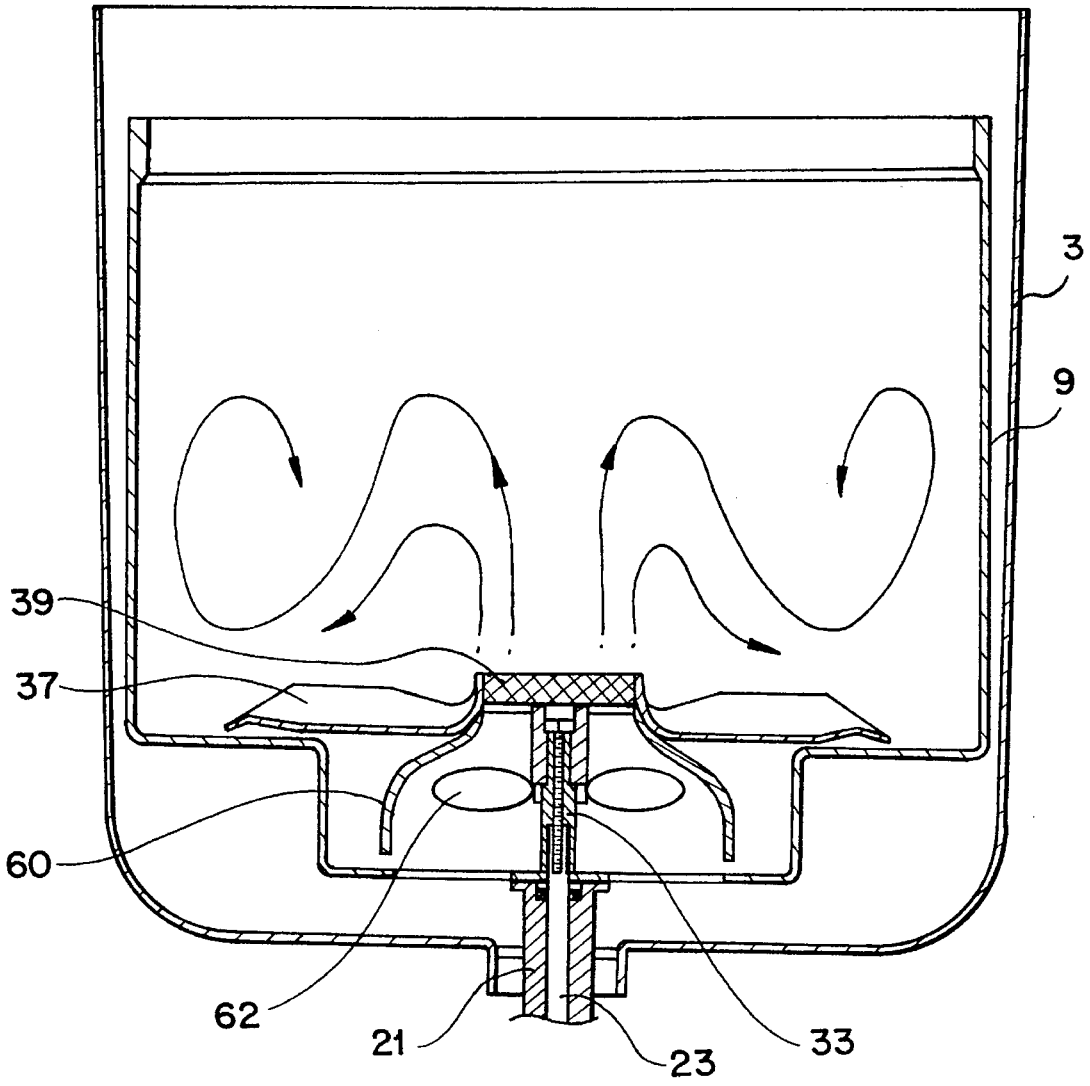
FIG. 6 is a longitudinal sectional view for illustrating the water current forming apparatus of a washing machine according to another embodiment of the present invention.

By way of example, another embodiment illustrated in FIG. 6 is possible without departing from the spirit and scope of the present invention where a conical housing member 60 is provided at a lower portion of the pulsator 37 and a pumping member 62 having an axial discharge type is secured to the connector 33, so that the centrally erupted water current is emitted from a center of the pulsator 37.

As is apparent from the foregoing, according to the present invention of the water current forming apparatus, a pumping member is so provided below a centrally erupted water current ejected upwards from a central portion of a washing-cum-spindrying tub, thereby preventing the laundry from being entwined and, at the same time, improving the washing and rinsing effects.

Having described specific present embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A clothes washing machine comprising:

an outer tub;

an inner tub disposed within said outer tub and being rotatable relative thereto about a vertical axis for centrifugally spin-drying laundry;

a pulsator disposed at a bottom of said inner tub, said pulsator including generally radially outwardly projecting agitating blades, and an upwardly directed opening disposed between radially inner ends of said blades and intersected by said vertical axis;

a motor-driven spin drying shaft connected to said inner tub to rotate said inner tub about a vertical axis for centrifugally spin-drying laundry;

a motor-driven washing shaft connected to said pulsator for oscillating said pulsator about said vertical axis to agitate water and laundry in said inner tub;

said inner tub defining a space beneath said opening, said space including a wash water inlet for receiving washing water, and a wash water outlet defined by said opening for ejecting wash water upwardly into a central region of said tub; and a pumping member disposed in said space between said wash water inlet and wash water outlet and operably connected to said washing shaft to be oscillating thereby for drawing wash water into said space and ejecting wash water through said opening for generating an upward water current in said central region of said inner tub, said upward water current cooperating with a water current established by said agitator blades to urge clothes outwardly toward a wall of said inner tub.

2. The clothes washing machine according to claim 1 further including guide walls below said pulsator for defining said space and guiding water pumped by said pumping member upwardly to said opening.

3. The clothes washing machine according to claim 2 wherein said guide walls are fixed to said inner tub.

4. The clothes washing machine according to claim 2 wherein said guide walls are affixed to said pulsator.

5. The clothes washing machine according to claim 1 wherein said pumping member includes blades movable with said washing shaft about a vertical axis and having a radial water discharge.

6. The clothes washing machine according to claim 1 wherein said pumping member includes blades movable with said washing shaft about a vertical axis and having an axial water discharge.

7. The clothes washing machine according to claim 1 including a filter disposed in said opening.

8. A water current forming apparatus of a washing machine, which comprises an outer tub for storing the washing water, a washing-cum-spindrying tub disposed within the outer tub to thereby spindry the laundry by way of centrifugal force, a spindrying shaft arranged under a central bottom area of the washing-cum-spindrying tub in order to rotate the washing-cum-spindrying tub according to the driving force of a power transmission apparatus, and a washing shaft rotatably disposed within the spindrying shaft, the apparatus further comprising:

a connector fixedly arranged at a periphery of the washing shaft;

a pumping member disposed at a periphery of the connector in order to pump the washing water stored in the outer tub and to eject the same toward an upper central area in the washing-cum-spindrying tub;

a pulsator for being provided at the connector in order to agitate the laundry and the washing water in the washing-cum-spindrying tub; and a housing member for being disposed in the washing-cum-spindrying tub in order to guide the water current formed in accordance with operation of the pumping member, wherein the housing member is formed with an opening so that the washing water absorbed through the suction inlet according to rotation of the pumping member can flow into the pumping member, and the housing forms at an upper portion thereof an open space for receiving the pumping member, while the open space is provided at an upper side thereof with a cover member in order to guide the washing water discharged from the pumping member and to prevent the discharged washing water from being washed away.

* * * * *